US005713185A

United States Patent [19]

Lindström et al.

[11] Patent Number: 5,713,185

[45] Date of Patent: Feb. 3, 1998

[54] WRAPPING METHOD FOR PRODUCING A PACKAGE AND FOR WRAPPING AN ARTICLE

[75] Inventors: Christer Jean Lindström, Espoo; Carola Maj-Len Lindström, Helsinki; Viljo Juhani Rytkönen, Espoo, all of Finland

[73] Assignee: LVC-Group Ltd. Oy, Espoo, Finland

[21] Appl. No.: 619,624

[22] PCT Filed: Sep. 27, 1994

[86] PCT No.: PCT/FI94/00434

§ 371 Date: Apr. 5, 1996

§ 102(e) Date: Apr. 5, 1996

[87] PCT Pub. No.: WO95/09769

PCT Pub. Date: Apr. 13, 1995

[30] Foreign Application Priority Data

| | | | |
|---|---|---|---|
| Oct. 7, 1993 | [FI] | Finland | 934398 |
| Jun. 30, 1994 | [FI] | Finland | 943136 |

[51] Int. Cl.[6] ..... B65B 11/00; B65B 23/00

[52] U.S. Cl. ..... 53/449; 53/472; 53/433; 53/452; 53/463; 53/466

[58] Field of Search ..... 53/449, 472, 433, 53/452, 466, 463, 461

[56] References Cited

U.S. PATENT DOCUMENTS

| | | | |
|---|---|---|---|
| 3,340,669 | 9/1967 | Farquharson | 53/472 X |
| 3,739,545 | 6/1973 | Lattke | 53/466 X |
| 4,267,684 | 5/1981 | Ambrose | 53/472 |
| 4,653,251 | 3/1987 | Ambrose | 53/434 |
| 4,662,148 | 5/1987 | Nilsson | 53/466 X |
| 4,918,904 | 4/1990 | Pharo | 53/472 X |
| 5,129,512 | 7/1992 | Garwood | 53/449 X |
| 5,133,173 | 7/1992 | Draghetti et al. | 53/466 |
| 5,272,856 | 12/1993 | Pharo . | |

*Primary Examiner*—Linda Johnson

*Attorney, Agent, or Firm*—Kolisch, Hartwell, Dickinson, McCormack & Heuser

[57] ABSTRACT

A method of the invention enables the production of a tubular package open at both ends and comprising a double- or multi-layered film. The film layers can be of one and the same or different materials. A package is formed around a mould (10), which is easily replaceable and determines the eventual size of the package (29). The method, which can be automated, includes producing the package (29), wrapping an article (25) and placing the article (25) in the package (29). The sections of said mould (10) are withdrawn from the package and the space in between the layered film is filled (23, 24) with air or some other gas, whereby the article attaches to the package.

20 Claims, 8 Drawing Sheets

WRAPPING METHOD FOR PRODUCING A PACKAGE AND FOR WRAPPING AN ARTICLE

The present invention relates to a method, wherein a tubular wrapping used as a package and consisting of an inner and outer film is produced in a packaging machine and an article to wrapped is sealed by means of air or some other gas to be blown into a space between the films included in the tube.

U.S. Pat. No. 4,918,904 discloses a wrapping method, wherein the package comprises a double bag having an opening on one side. When wrapping, an article must be inserted inside the bag through the opening. The wrapped article is fixed in the bag by means of air or other gas to be blown into a space between the films. This bag is poorly adaptable to automatic wrapping as the bag must be opened along the open side separately and in an individual operation. Bags of different sizes are required for articles of different sizes. Bags must be pre-designed and pre-produced for various products. Thus, this method is primarily suitable for manual wrapping and has a limited range of applications.

Prior known are also methods employing moulds and various foam plastics, such as expanded polystyrene or urethane, for producing a protective material for various products. This is an expensive method which also produces a lot of package material waste. An individual mould must be separately constructed for each product or article, which is a tedious and uneconomical solution. Packing an article in these protective materials requires a lot of manual labour and calls for a separate package storing facility and also intermediate storages for the actual packaging or wrapping materials.

An object of this invention is to provide a novel wrapping method which does not involve the above drawbacks.

Among the most important benefits offered by the invention are the facts that the method is extremely well adaptable to automated wrapping and that the method not only produces a package but also packages an article and that the inner and outer films can have different compositions, for example the inner film can be antistatic and the outer film non-antistatic or the inner film resistant to sharp objects and the outer film impervious to light and that, by replacing the mould, one and the same plastic material can be used for quickly producing packages of varying sizes in compliance with the production of articles in question and that the usable materials include environmentally friendly film materials. Since the tube is open at both ends thereof, the insertion of an article in the tube is easy by using automatics and since the inner film moulds itself around an article to be wrapped regardless of its shape, the article will be well protected against external impacts and the article to be wrapped remains immobilized in the package. Thus, this method is highly adaptable to the automated wrapping of articles of varying sizes and requiring various protective materials as a part of production regardless of the degree of automatization used in the production of articles to be wrapped.

This method reduces considerably the waste and recycling problem of spent packages if compared, for example, to foam-plastic based, article-protecting materials, such as expanded polystyrene or urethane, since an empty tube requires just a fraction of space if compared to the above foam-plastic based solutions or other solid-structure based solutions. The method also enables the elimination of moulds carefully designed for a particular article to be wrapped and solid materials used in a package. The demand for storage space is reduced as the package is produced as a result of the wrapping process and there is no need for producing empty packages.

Referring to what is described above, this method is more flexible, environmentally more friendly, quicker and more economical than the prior known solutions.

A method of the invention for producing a package and for wrapping an article will now be described in detail by way of an exemplary embodiment with reference made to the accompanying drawings.

FIG. 1 depicts a method of the invention, wherein numeral 1 refers to a reel of film or a similar device for supplying a film material.

Figure 1:
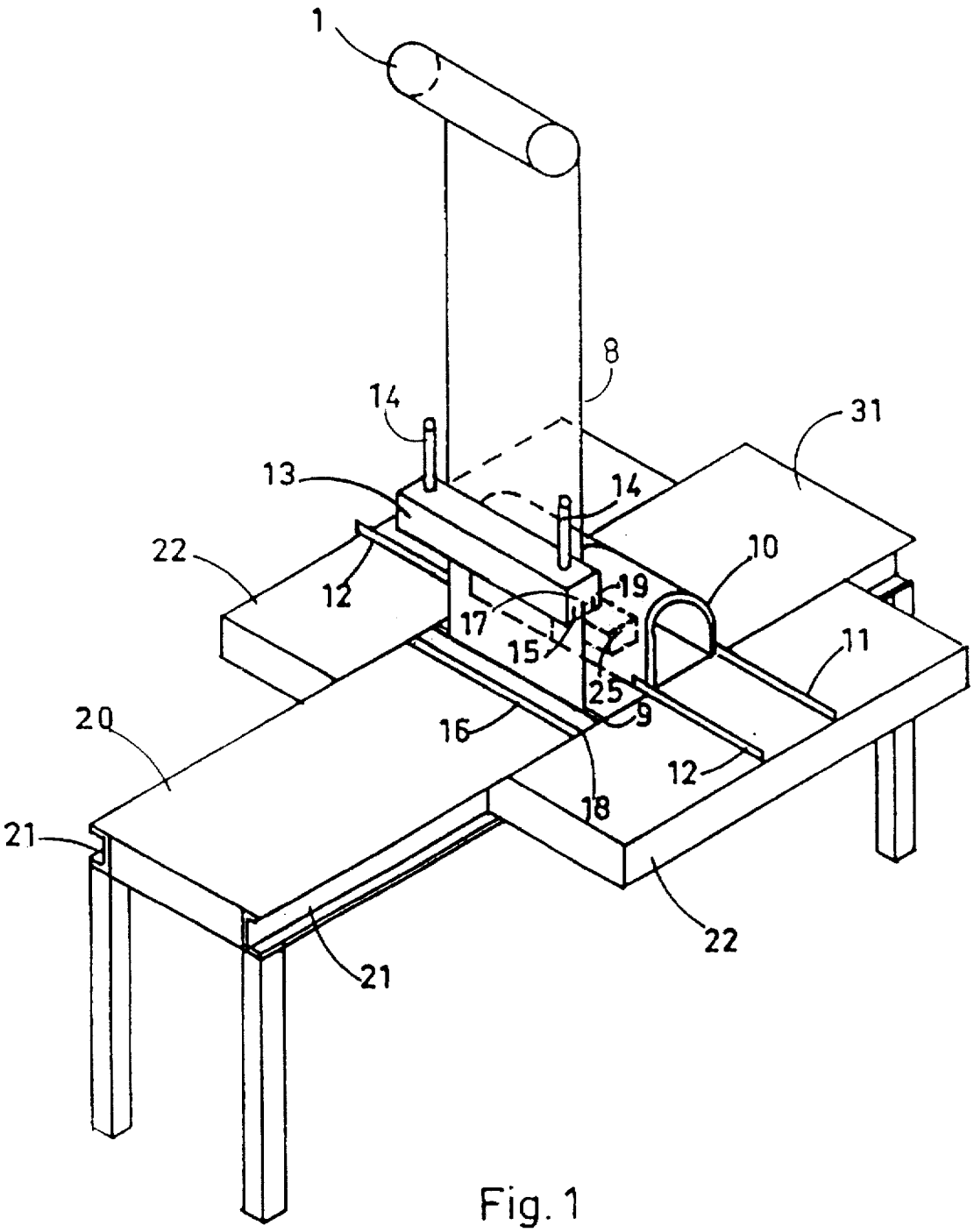
FIGS. 1–6 depict various operations included in the method.

A film material 8 coming out of the roller 1 is tubular.

The end of film 8 is fixed in a fastening device 9.

A mould 10 is a two-section, completely or partially floorless arch and both halves can slide away from each other along guide rails 11 and 12.

The size of a finished package is determined according to the replaceable mould 10.

The device 13 is capable moving up and down along guides 14.

Figure 8:
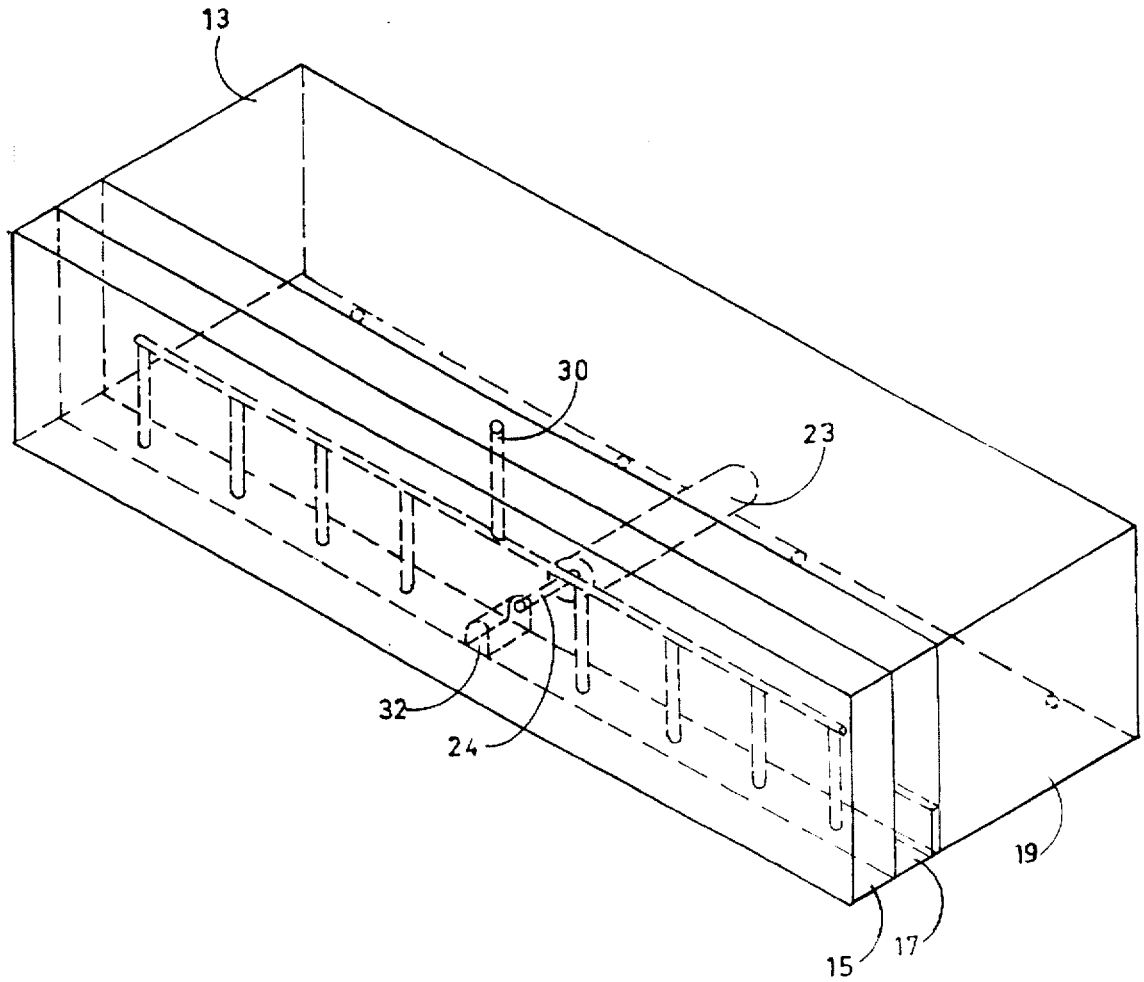
FIG. 8 shows a device 13.

The device 13, FIG. 8, comprises three different components 15, 17 and 19 capable of independent action. The component 15 is a counterblock for a heat sealer and the heat sealer 16 is mounted on a fixed base 20.

The component 17 is provided with a recess for a cutter 18, which is mounted on a fixed base, as well as a suction device 30 required for lifting the film.

The component 19 includes a filling device 23 for filling the package with air or some other gas and said component 19 guides the double film 8 into the fastening device 9.

The base is provided with guide rails 21 and a carriage 22 travels along the guide rails 21.

The guide rails 11 and 12 for the mould 10 are mounted on the carriage 22 and the mould travels along with said carriage 22, FIG. 1.

Figure 6:
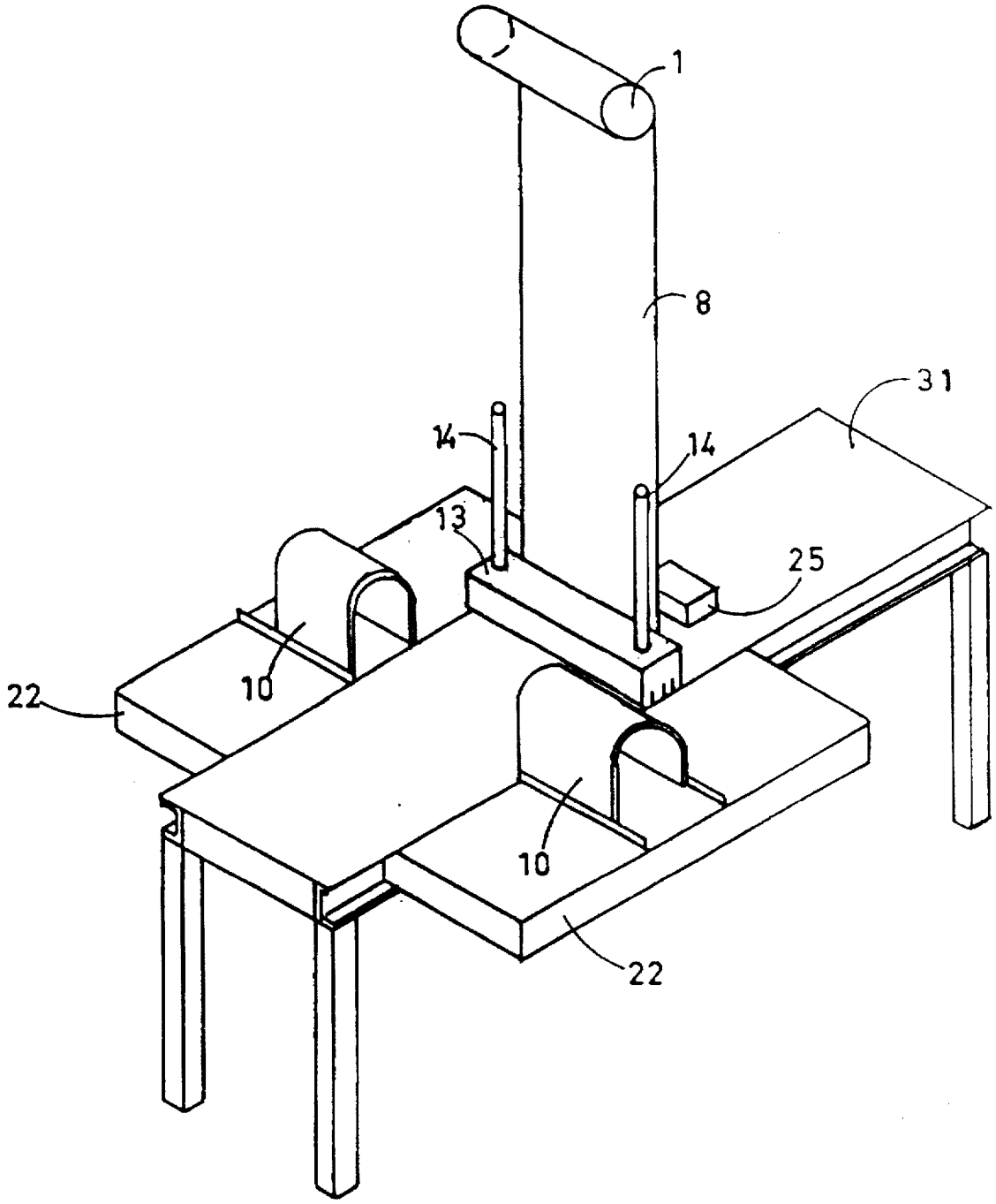

The preparation of a package in accordance with the method is initiated with the entire assembly in the condition depicted by FIG. 6.

An article 25 received from a production line arrives on a plate 31.

The carriage 22 travels to the right from the position shown in FIG. 6.

Figure 2:
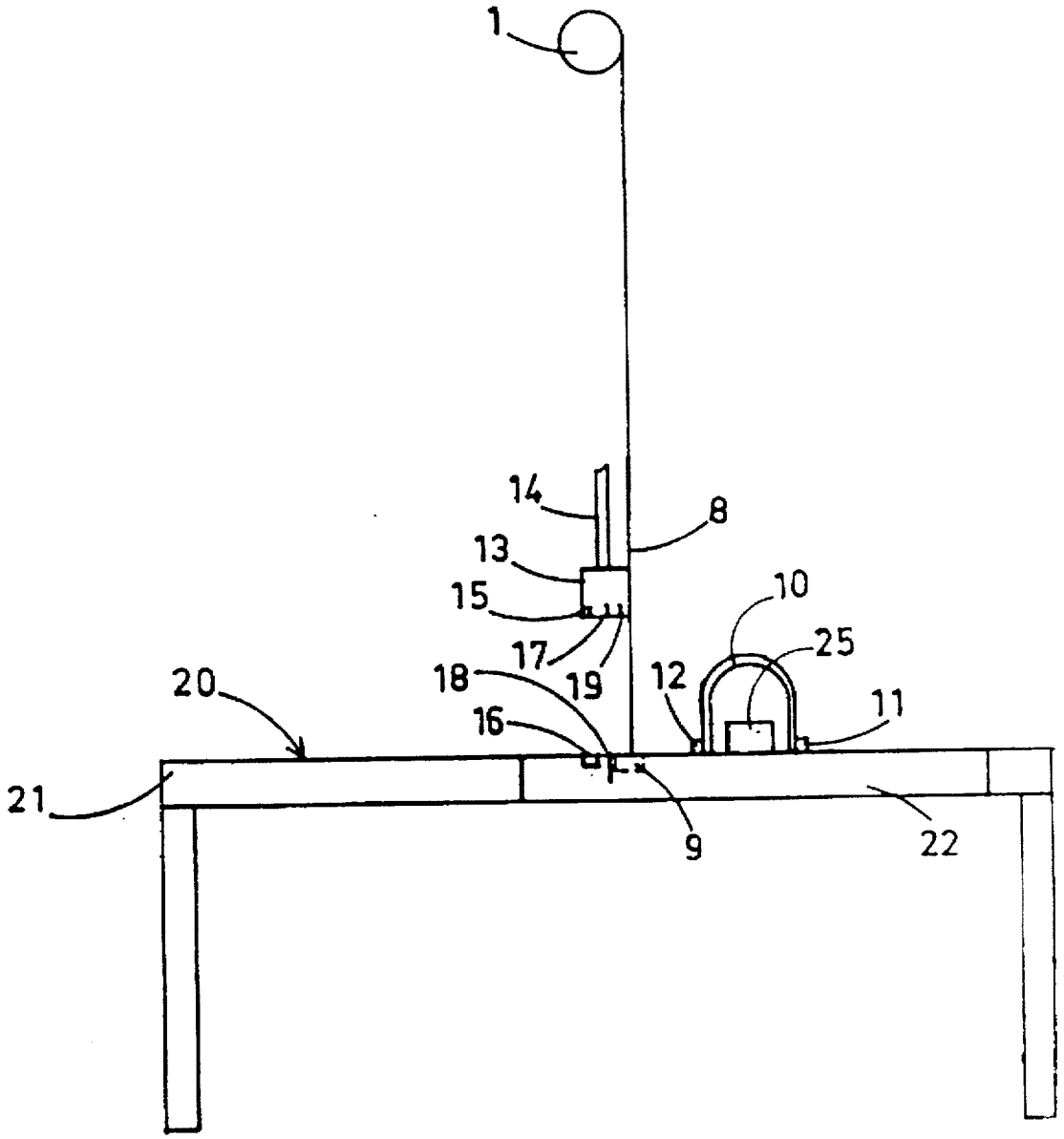

The sections of mould 10 come together and close the article 25 inside the mould 10, as shown in FIGS. 1 and 2.

Figure 3:
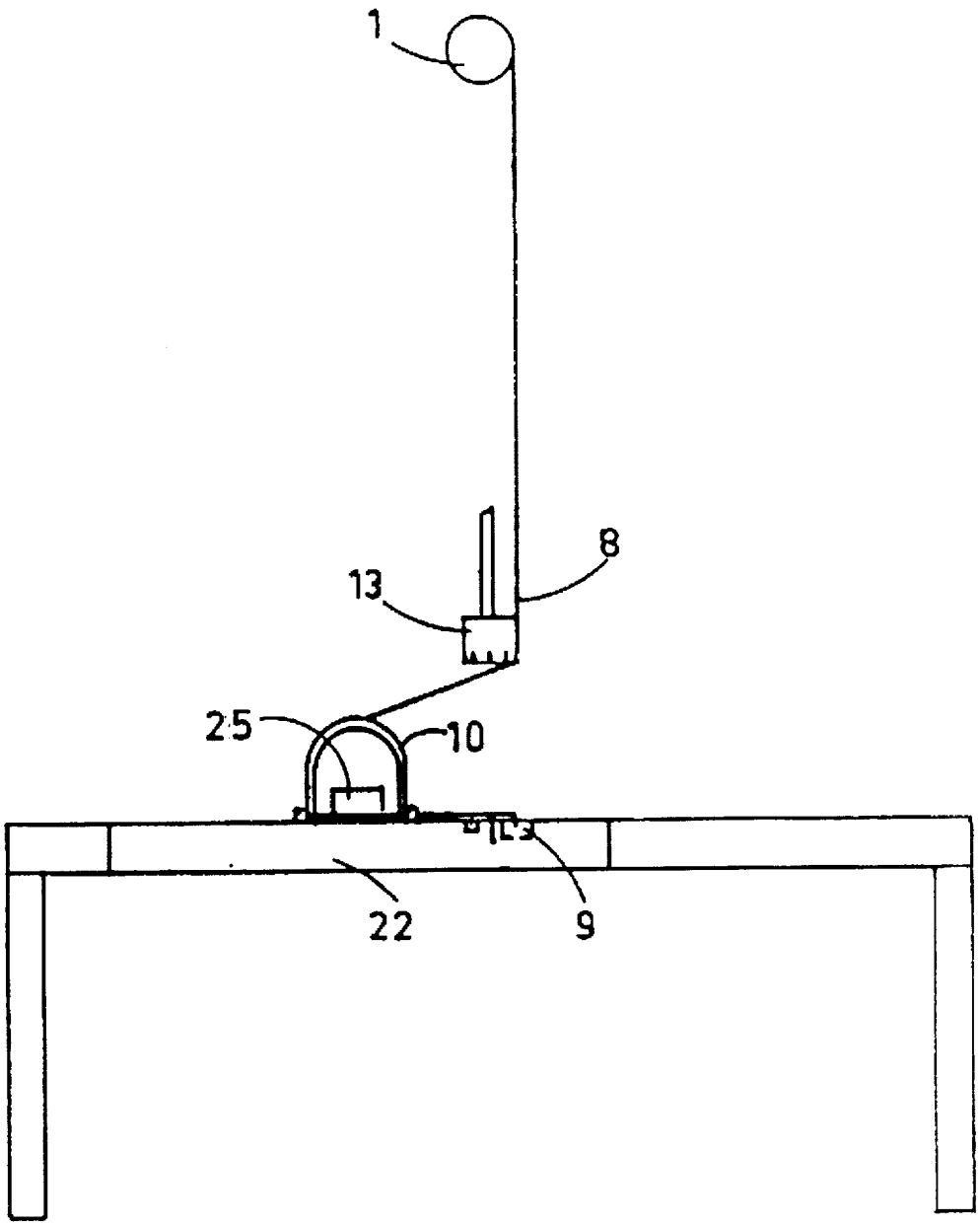

The carriage 22 travels to the left from the position shown in FIG. 2 and carries along the mould 10 with the article 25 thereinside, whereby the film 8, which is fixed in the device 9, wraps around the mould 10 as shown in FIG. 3.

Figure 4:
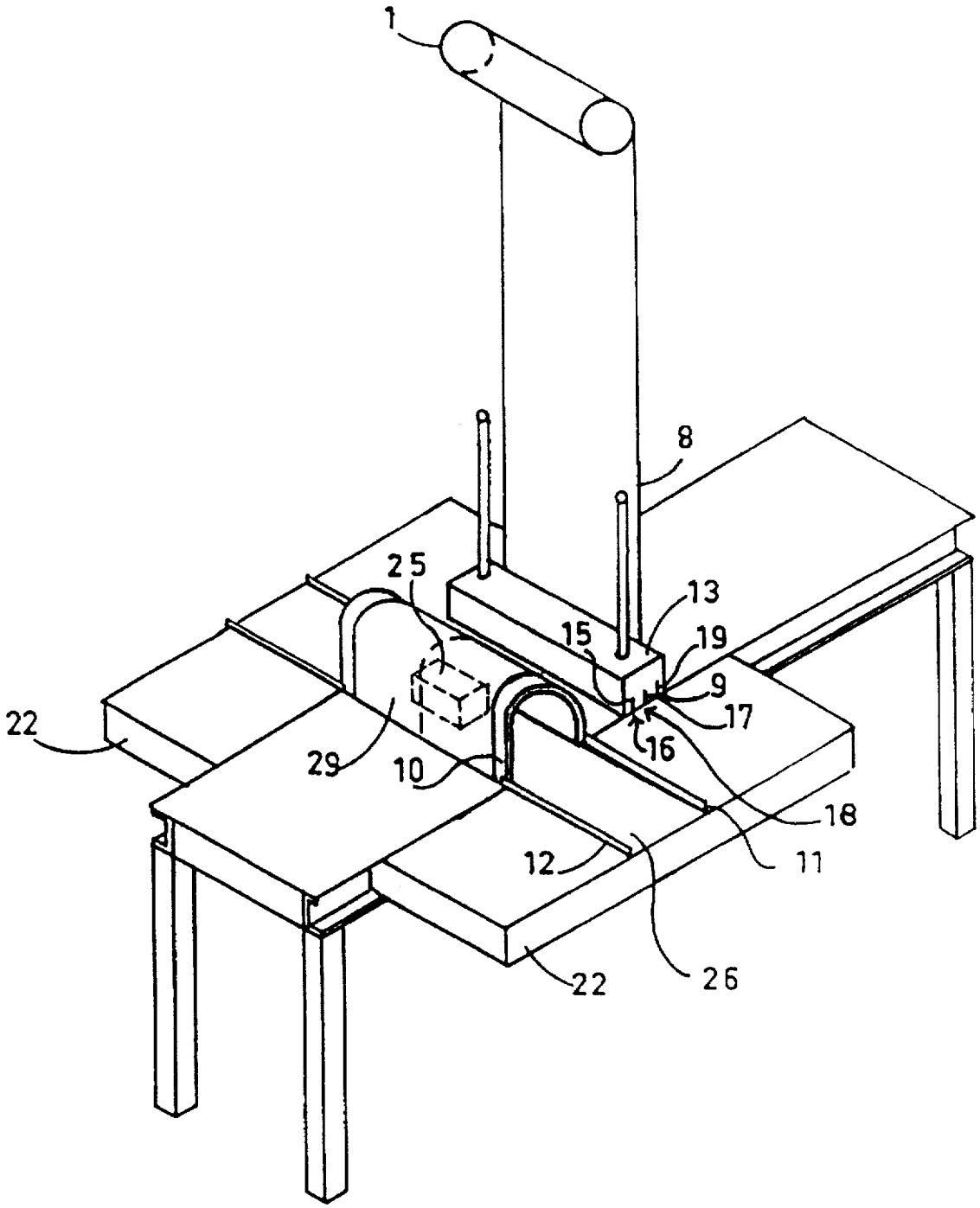

As the movement of carriage 22 and thereby that of the mould 10 stops, the device 13 descends and takes along the film 8, as shown in FIGS. 3 and 4.

Figure 5:
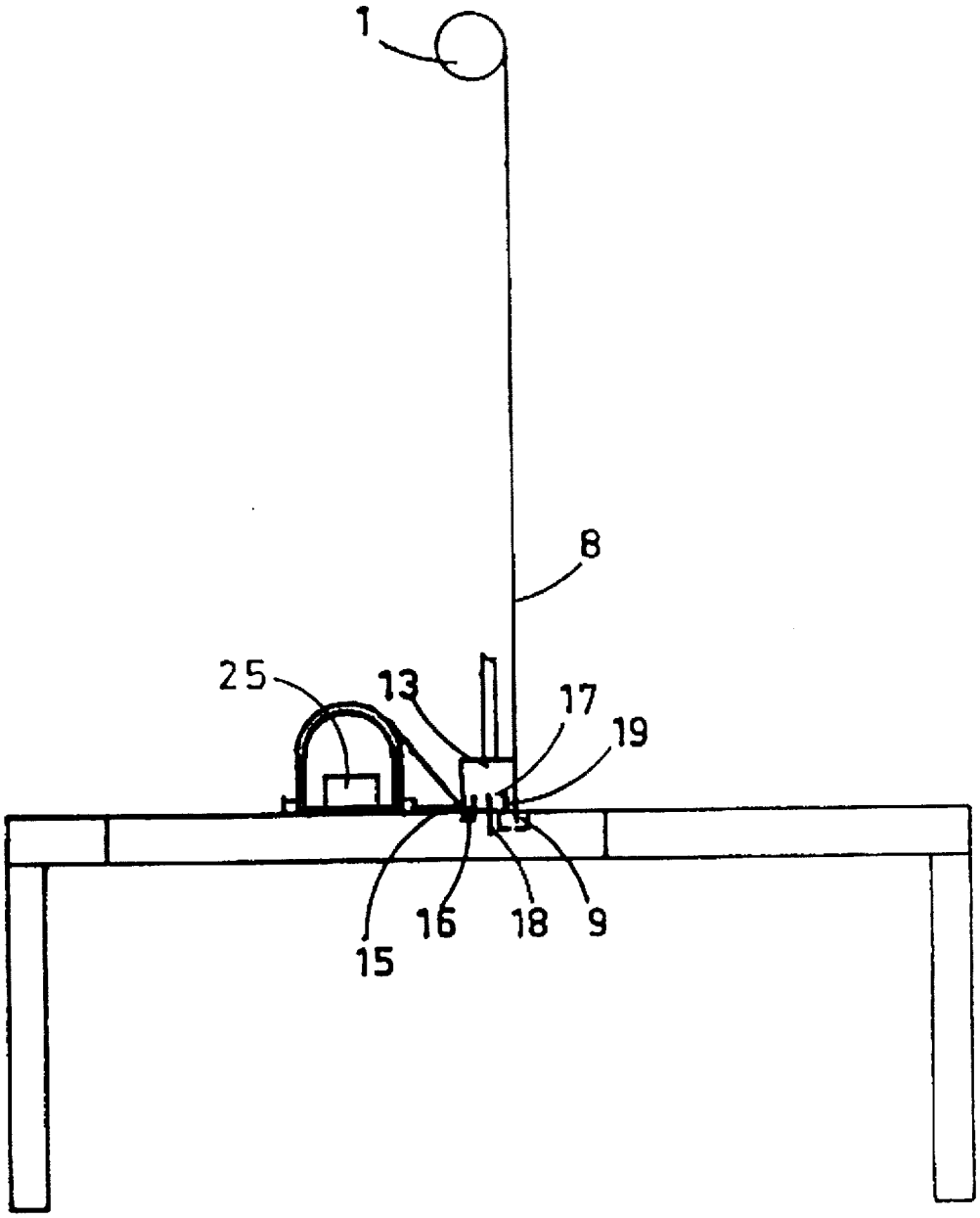

When the device 13 has reached its bottom position, FIGS. 4 and 5, a cutter 18 severs the film against a component 17, said component 17 adheres to the top film, FIG. 8, by means of a suction device 30 and, as it rises from its bottom position, said component lifts the film away from other film layers.

A nozzle 24 included in the filling device 23 finds its way underneath the lifted film layer and the component 17 descends to its bottom position and the nozzle 24 sets in a crosswise recess or groove 32 included in the component 17.

The sections of said two-section mould 10 slide outwards from inside a tube 29 from the position of FIG. 4 vacating the space between the films of said tube to be filled with air or some other gas. The Component 15 rises and, thus, there is nothing to stop an air stream from the nozzle 24 of said filling device 23 from filling the package with air or some other gas, whereby the inner film of said package is wrapped around the article. The component 17 retains the package stationary during the filling operation and sealed in its air space with the exception of the air filling recess 32.

The component 15 descends to its bottom position and the heat sealer 16 heat seals the package hermetically.

The device 13 ascends to its initial position, whereby the package is finished and separated from the device.

Figure 7:
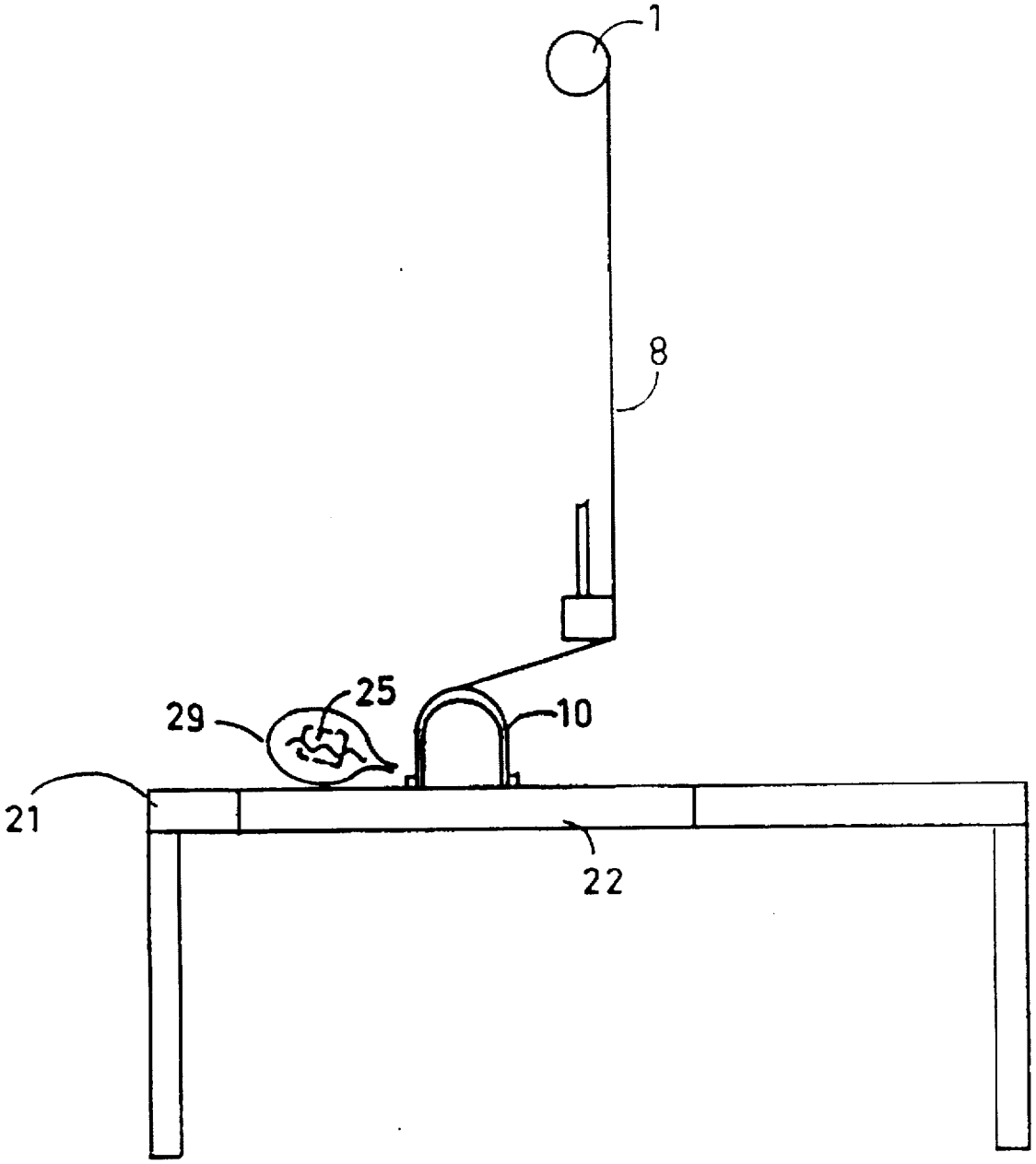
FIG. 7 shows a finished package including an article.

The preparation of another package can now begin, FIG. 6. A mould for preparing another package pushes the finished package forward, FIG. 7, for example onto a conveyor or into a package container.

The invention is not limited to the embodiment described in the specification and drawings but it can be modified within the scope of the appended claims, as explained hereinafter.

For example, in order to create a tubular form for the film material, it is possible to employ a flat film coming from two reels or similar film material supply devices and to seal their edges together or it is possible to employ a single film having a sufficient width, which is folded and whose edges are sealed together.

Placing an article in the mould is also possible at the end of a wrapping method with the mould still inside the plastic films, whereby the article is placed inside the mould and the mould sections move apart and the space between the films is filled with air and the article attaches to the package.

The space between films can be made airtight by fitting the package with a valve, the space between films being filled through the valve.

In the illustrated embodiment, the heat sealer 16 is mounted on a fixed base 20 and the counterblock for the sealer on a movable device 13. The sealing can also be realized by mounting the heat sealer 16 on a movable device 13 and the counterblock for the sealer on a fixed base.

Producing a package for sizable smooth-surfaced articles is also possible by having a partial mould protect the article.

The illustrated embodiment includes a cutter 18 on a fixed base 20 and the groove or recess for the cutter on a movable device 13. The cutting of a film can also be realized by mounting the cutter 18 on movable device 13 and the groove or recess for the cutter on fixed base 20.

I claim:

1. A wrapping method for producing a package and for wrapping an article within a multi-layered film having a gas-filled space formed between an outer and an inner film, comprising the steps of:

placing an article to be wrapped within a two-section mould wrapping a multi-layered film around the two-section mould;

cutting the multi-layered film;

moving the two mould sections apart;

filling a space between an inner and an outer layer of the multi-layered film with gas so that the inner package film conforms to the article to be wrapped; and making the space between the inner and outer layers of the multi-layered film airtight.

2. A method as set forth in claim 1 wherein at least one of the mould sections is at least partially without a floor.

3. A method as set forth in claim 1 wherein at least one of the mould sections is replaceable for the production of packages of varying sizes and shapes.

4. A method as set forth in claim 1 wherein the step of filling a space between an inner and an outer layer of the multi-layered film includes the step of using a filling device that facilitates the automatic filling of the space between the inner and outer layers of the multi-layered film with gas.

5. A method as set forth in claim 1 wherein the multi-layered film is tubular or comprises a single film whose edges are sealed together or two or more films whose edges are sealed together.

6. A method as set forth in claim 1 wherein the step of placing an article to be wrapped within a two-section mould is performed before all of the other identified steps.

7. A method as set forth in claim 1, further comprising the steps of:

forming an air filling hole between the inner and outer layers of the multilayered film;

forcing gas through the air filling hole; and then making the air filling hole airtight either by sealing or by means of a valve.

8. A method as set forth in claim 1, further comprising the steps of:

transferring the two-section mould at least partially enclosing the article to be wrapped underneath a combined sealing, cutting and filling device in such a way that the two-section mould pushes the layers of the multi-layered film to form a blank partially surrounding the mould; and sealing said blank to form a tube surrounding the mould and having open ends.

9. A wrapping method for producing a package and for wrapping an article, comprising the steps of:

providing an article to be wrapped;

providing a film and wrapping the film at least partially around the article to form an inner film;

providing a film and a mould and wrapping the film at least partially around the mould to form an outer film;

placing the inner film inside the outer film;

sealing the inner film to the outer film to form a gas-fillable space between the inner film and the outer film;

placing the article inside the inner film; and filling the gas-fillable space with a gas.

10. A method as set forth in claim 9 wherein the mould is at least partially without a floor.

11. A method as set forth in claim 9 wherein the film provided for wrapping to form the inner film is tubular.

12. A method as set forth in claim 9 wherein the film provided for wrapping to form the outer film is tubular.

13. A method as set forth in claim 9 wherein the step of placing the article inside the inner film is performed simultaneously with the step of wrapping the film at least partially around the mould.

14. A method as set forth in claim 9 wherein the step of placing the article inside the inner film is performed after the step of wrapping the film at least partially around the mould.

15. A method as set forth in claim 9 wherein the step of placing the article inside the inner film is performed before the step of wrapping the film at least partially around the mould.

16. A method as set forth in claim 9 further comprising the steps of:

forming an air filling hole between the inner film and the outer film to communicate with the gas-fillable space;

forcing gas through the air filling hole; and then making the air filling hole airtight either by sealing or by means of a valve.

17. A method as set forth in claim 9 wherein the step of wrapping the film around the mould to form the outer film comprises the step of pushing the mould through a film, thereby wrapping the film at least partially around the mould to form the outer film.

18. A method as set forth in claim 17 further comprising the step of sealing the outer film to form a package blank at least partially surrounding the mould.

19. A wrapping method for producing a package and for wrapping an article, comprising the steps of:

providing an article to be wrapped;

providing a mould and placing the mould adjacent the article;

providing a multi-layer film and wrapping the film at least partially around the article and the mould to form an inner film at least partially surrounding the article and to form an outer film at least partially surrounding both the article and the inner film;

sealing the inner film to the outer film to form an air-fillable space between the inner film and the outer film; and filling the air-fillable space with a gas.

20. A method as set forth in claim 1 wherein the step of placing an article to be wrapped within a two-section mould is performed after the step of wrapping a multi-layered film around the two-section mould.

* * * * *